United States Patent [19]

Rao

[11] Patent Number: 4,670,020

[45] Date of Patent: Jun. 2, 1987

[54] CARBON IGNITION TEMPERATURE DEPRESSING AGENT AND METHOD OF REGENERATING AN AUTOMOTIVE PARTICULATE TRAP UTILIZING SAID AGENT

[75] Inventor: Vemulapalli D. N. Rao, Bloomfield Township, Mich.

[73] Assignee: Ford Motor Company, Dearborn, Mich.

[21] Appl. No.: 685,921

[22] Filed: Dec. 24, 1984

[51] Int. Cl.[4] ..... C10L 1/18

[52] U.S. Cl. ..... 44/57; 44/68

[58] Field of Search ..... 44/57, 68

[56] References Cited

U.S. PATENT DOCUMENTS

| | | | |
|---|---|---|---|
| 2,622,671 | 12/1952 | Johnson | 44/68 |
| 3,341,310 | 9/1967 | Drouven | 44/69 |
| 4,036,605 | 7/1977 | Hartle | 44/68 |
| 4,494,961 | 1/1985 | Venkat et al. | 44/68 |
| 4,522,631 | 6/1985 | Mourao et al. | 44/68 |

OTHER PUBLICATIONS

"The Condensed Chemical Dictionary", 8th Ed., pp. 638, 639, 232 and 229.

*Primary Examiner*—Jacqueline V. Howard

*Attorney, Agent, or Firm*—Joseph W. Malleck; Roger L. May

[57] ABSTRACT

A carbon ignition temperature depressing agent is disclosed along with a method of regenerating an automotive particulate trap using the ignition temperature depressing agent. The agent is effective to promote oxidation of on-board collected carbonaceous particles extracted from the automobile exhaust. The agent comprises (a) an organometallic compound that upon heating (the combustion process of the engine) forms a readily reducible metal oxide which when finely divided promotes a carbonaceous ignition temperature in the range of as low as 450° F. and up to as low as 675° F., and (b) an aerosol-promoting liquid carrier effective to form a fine mist with the organometallic compound when sprayed, the carrier having a boiling point in the range of 176°-302° F. (80°-150° C.). The organometallic compound is one or more metal octoates having the metal selected from the group consisting of copper, nickel and cerium. The organometallic compounds are readily soluble and stable in the fuel supply used with an internal combustion engine such as an automotive diesel engine. The mixture is used in a volume amount of 10-50 milliliters per gallon of fuel or the organometallic compound is present in an amount of at least 0.15-0.5 gm/gal of fuel. The organometallic compound is proportioned to the carrier in a ratio of 1:2 to 1:10. The aerosol-promoting liquid carrier is selected from the group consisting of hexane, pentane and toluene and is effective to promote a droplet size for said mixture when sprayed of substantially less, on average, of one micron.

15 Claims, 6 Drawing Figures

Regeneration Temperature: °F
1000
900
800
700
600
500
Standard D-2 Fuel
Reference 0.25Cu+0.5Pb
0.15Cu (□)
0.3Cu (□)
0.25Cu (□)
0.25Cu+0.25Ni (□)
0.25Cu+0.2Ce (□)
Exhaust Gas Temp. At Constant 55/60 MPH
(WOT)
(27MPH) 12 Sec
(40MPH) 14 Sec
(34MPH) 11 Sec
(31MPH) 9 Sec
(31MPH) 9 Sec
(Part Throttle Accel. Speed)
Formulation

CARBON IGNITION TEMPERATURE DEPRESSING AGENT AND METHOD OF REGENERATING AN AUTOMOTIVE PARTICULATE TRAP UTILIZING SAID AGENT

TECHNICAL FIELD

The invention relates to carbon oxidation catalysts and, more particularly, to agents for depressing the ignition temperature of soot in an automotive vehicular trap permitting such soot to be oxidized as a result of exhaust gas temperatures reached during normal driving cycles.

BACKGROUND OF INVENTION AND PRIOR ART STATEMENT

In an effort to cleanse the exhaust gases emanating from a diesel engine, carbon particulates occluded with hydrocarbons (soot) are collected from such exhaust by trapping and must be eliminated from the trap by periodic gasification or oxidation which requires ignition of the soot in the trap. The temperature of the exhaust gases during normal driving cycles is not high enough in passenger vehicle engine applications to ignite such soot and therefore requires some supplementary means to establish ignition and carry out oxidation. Even with truck engines, the driving cycle can create exhaust gas temperatures which are not always consistently high enough to burn off the carbon particles collected in such a trap.

It is well recognized that soot oxidation can be facilitated by means of an auxiliary fuel burner or auxiliary electric heater which functions to increase the temperature of the exhaust gases or other oxygen-carrying gas so as to bring about ignition. However, it would be desirable if such auxiliary temperature-increasing devices could be eliminated and the temperature of the normal driving cycle of the engine be relied upon to bring about ignition and carry out combustion of the collected carbon particles and occluded hydrocarbons (soot). To this end, it is desirable that the economics and reliability of carbon ignition be enhanced by some means which effectively lowers the ignition temperature of the particles.

The prior art has explored the use of various catalyst materials to reduce the ignition temperature of carbon soot (see Murphy et al, SAE Publication No. 810112, 1981 which describes carbon oxidation catalyst). In a related attempt, the prior art has learned that when a catalytic coating is applied or impregnated into the trap material, the function of regeneration (carbon oxidation) does not work as well as expected (see EPA Paper 600 7-79-232b, entitled "Assessment of Diesel Particulate Control: Direct and Catalytic Oxidation"; and a paper entitled "Catalysis of Carbon Gasification", published in *Chemistry & Physics of Carbon,* P. L. Webber, Jr., Editor, Vol. 4, pages 287–383, Marcel Dekker, New York, 1968).

The prior art has also turned to providing additives or injections into the fuel supply in the hopes of providing a chemical compound that would codeposit with carbon, facilitate lower ignition temperatures, and thereby provide more convenient oxidation of the carbon. Two problems are presented by such application mode: (a) the additives used heretofore have not only presented consistent problems of solubility in the fuel supply, but also are unstable over normal usage periods to maintain solubility; and (b) the inability to codeposit in a form that is effective to promote depression of the ignition temperature to a level that would accommodate exhaust temperatures reached during frequent driving cycles.

For example, in U.S. application Ser. No. 585,964, filed March 5, 1984, assigned to the assignee of this application (the disclosure of which is incorporated herein by reference), a teaching is made of a way to utilize copper and lead as additives to the fuel supply to reduce the soot oxidation temperature. The additive formulation consisted of adding 0.25 gm/gal of fuel in the form of copper napthanate and 0.5 gm/gal of fuel as lead in the form of tetraethyl lead. Although the formulation as added to the fuel supply was effective in reducing the ignition temperature of soot, it was found that the liquid additive formulation was extremely unstable in diesel fuel and required an eloborate on-board additive dispensing system to make it suitable for the vehicular applications. In addition, lead additives are toxic and pose serious problems relating to regulations for their use in diesel fuel in the United States. More importantly, reductions in ignition temperatures to levels experienced in ordinary engine operation was not achieved and the oxidation process was not necessarily sustainable when the particles were ignited.

To solve the solubility problem, U.S. Pat. No. 2,622,671 had long ago proposed that copper salts of alkanoic acids be used to achieve ignition temperature depression in connection with oil burning equipment such as oil burning locomotives, fire-up torches, etc., all using extremely large fuel burning nozzles. The disclosure of the '671 patent describes the copper salts as being of the type having a branch chain acyclic aliphatic carboxylic acids of 5–12 carbon atoms, and in which the carboxyl group is attached to a carbon atom other than the central carbon atom in the longest hydrocarbon chain. These useful copper salts of alkanoic acids were found to be suitable only with oil burners with large nozzles, but would be completely unacceptable in achieving ignition temperature depression in a vehicular particulate trap substantially removed from the burning location and where very small, intricate trap passages are involved with a relatively lower and cooler exhaust flow therethrough. Moreover, soot generation in such large oil burners occurs at a very low pressure environment (1.5 bar) and is due to the very low air/fuel ratio allowing the carbon to break down prior to combustion. The environment within a vehicular engine operation is different since the air/fuel ratios are quite large with pressures exceeding 20 bar. In fact, such air/fuel ratios in vehicles can be 80 or more while still obtaining carbon deposits. Still further, the mere use of copper salts of alkanoic acids as an additive to the fuel supply is insufficient to obtain significant ignition temperature depression of soot in a particulate trap of an automotive vehicle, principally because the additive, by itself, does not provide compounds which lay down in a sufficiently fine particle size and spacing to promote catalytic ignition at normal driving conditions.

More importantly, not all of the delineated salts in U.S. Pat. No. 2,622,671 would reduce the carbon ignition temperature sufficiently low and certainly not to a range below 700° F. In fact, none of such salts would do so by itself when injected as an additive to a diesel fuel supply. Even though such salts respond to the definition of a metal octoate salt of the formula [COH]M, with which this invention is concerned, most of these salts are incapable of forming an oxide which upon heating can be finely distributed.

SUMMARY OF INVENTION

The invention is a carbon ignition temperature depressing agent and a method of regenerating an automotive particulate trap utilizing the ignition temperature depressing agent. The agent is to be used as an addition to the fuel supply for an internal combustion engine and is effective to promote oxidation of collected soot or carbonaceous particles extracted from the exhaust gas of the engine. The agent comprises: (a) an organometallic compound that upon experiencing the combustion process of the internal combustion engine forms a first metal oxide readily reducible upon reheating by said exhaust gas to a second metal oxide of lower oxygen level, which second metal oxide the degree of oxygen level change, depending on how finely divided and the degree of intimate concentration with said particles, promotes oxygen transfer and thereby a carbonaceous ignition temperature in the range of 450°-675° F., and (b) an aerosol-promoting liquid carrier effective to form a fine mist with the organometallic compound and fuel supply when sprayed for initiating said internal combustion.

Preferably, the carrier has a boiling point in the range of 176°-302° F. (80°-150° C.) and is preferably selected from the group consisting of hexane, pentane and toluene.

The organometallic compound is a metal octoate or octoate complex with the metal selected from the group consisting of copper, nickel and cerium. Advantageously, copper octoate or octoate complex can promote a lower ignition temperature without reversible oxygen transfer between the first and second oxides; however, use of copper octoate or octoate complex used in combination with nickel or cerium octoate or octoate complex promotes a lower ignition temperature with reversible oxygen transfer between the first and second oxides. Such organometallic compounds are readily soluble and stable in the fuel supply used with an internal combustion engine such as a diesel engine.

The metal octoates herein have the formula $[C_xO_yH_z]_nM$, where M is the metal and x is in the range of 8-16, y is in the range of 2-4, z is in the range of 12-18, and n is 1-4. Preferably, the organometallic compound is proportioned within such agent to the carrier in a volumetric ratio of 1:2 to 1:10. The first metal oxide, formed as a result of heating the organometallic compound by the internal combustion of the engine, has a molecular formula of $M_xO$, where M is the metal and x is in the range of 0.5-3.0, rendering a multiple oxygen level associated with the metal atom. Optimally, the organometallic compound is a combination of said selected octoates or octoate complexes, the combination being present in the fuel supply in an amount of at least 0.5 gm/gal of fuel.

The method of regenerating a particulate trap utilizing the ignition temperature depressing agent comprises the steps of: (a) uniformly codepositing carbon particles and selected metal oxides within the trap, said carbon particles being deposited in a particle size range of 50-60 angstroms, the selected metal oxides being deposited in a particle size range of less than 500 angstroms and in sufficient intimate concentration with said deposited particles to promote, upon reheating by the exhaust gas, oxygen transfer and thereby continued reduction of said oxides to a lower level of oxygen associated with the metal atom and to catalyze the ignition of the carbon particles in the temperature range of 450°-675° F. (250°-357° C.); and (b) when the deposited density of the carbon particles and metal oxides has reached a predetermined density, operating the engine associated with the particulate trap at a speed, load and acceleration condition to increase the exhaust gas temperature and thereby the trap temperature to as low as 450° F. and up to below 675° F. (250°-357° C.) and sustaining said trap temperature over a period of at least eight seconds to reheat said metal oxides, the metal oxides functioning under such trap temperature and exhaust gas flow to reduce and supply oxygen for the chemical oxidation of the carbonaceous particles.

Preferably, codeposition is carried out by introducing a flow of exhaust gases from said engine, the exhaust gases carrying the carbon particles and metal oxide particles in a finely divided condition; during ignition and regeneration, the exhaust flow is at least 0.5-2 atmospheres to facilitate an oxygen concentration to stimulate oxidation. Ignition temperature and trap back-pressure are related in that ignition will take place, when using the additives taught herein, at as low as 540° F. if the back-pressure ratio of a soot loaded trap to a clean trap is 3.0 or greater, but the ignition temperature will be increased by 35° F. for every 0.5 decrease in the ratio.

Advantageously, the ignition temperature depressing agent added to the fuel supply comprises a mixture of at least two of said octoates or complexes and are present in the fuel supply in a combined amount of at least 0.5 gm/gal of fuel.

It is preferable to add the agent to the fuel supply in an amount of at least 0.15 gm/gal of fuel; the ignition temperature will depend on the interrelationship of the amount of metal octoate or octoate complex added, the density of the collected carbonaceous particles, and on the specific metal or combination of metals used for the octoate or octoate complex.

DETAILED DESCRIPTION AND BEST MODE

Figure 1:
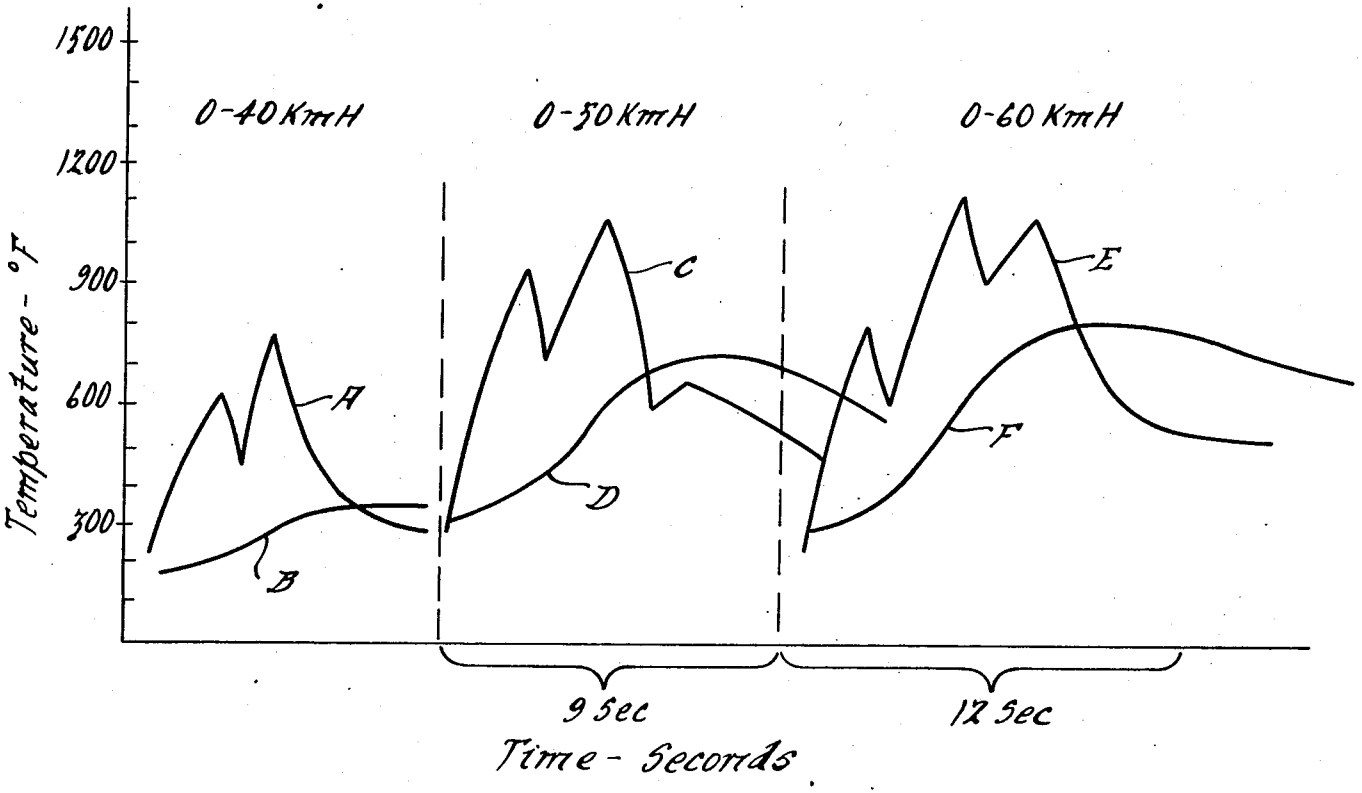

To meet proposed emission requirements for diesel engines, trap structures are being designed to catch and hold the soot from such engine until such time as either engine operating conditions increase the exhaust gas temperature or another heat source is employed to increase a gas temperature, such gases heating the trap structure to ignite and produce oxidation of the soot. This disclosure is concerned with deployment of an additive to be made to the fuel supply for such engine which leads to the deposition of an oxide or an oxide mixture effective to reduce the ignition temperature of the soot (carbonaceous particles) and thereby allow soot burn-off with ordinary engine operation.

Additives known and used by the prior art have been found either not capable of lowering the ignition temperature of the carbonaceous particles sufficiently or have been found significantly unstable in diesel fuel requiring an elaborate on-board fuel additive dispensing system to be suitable for vehicular application. The environment for carbon ignition in such a trap is one where there is good oxygen concentration due to the pressurized flow of the exhaust gases, but such oxygen concentration is reduced as back-pressures build up as the trap becomes more laden with carbon. If such oxygen concentration were to be reduced to ambient pressure conditions (no flow), the carbon ignition temperature would have to be 150° F. higher. The normal exhaust gas temperature of typical engine driving conditions during acceleration from zero to 60 mph will transmit enough heat to provide a trap wall temperature in the range of 590°-700° F. when sustained for 7-8 seconds, assuming the trap is not allowed too high a back-pressure by soot clogging. A fuel additive that would promote ignition of the soot in that temperature range and lower is desirable.

It has been found by this invention that to have the additive or agent (a) stable in the fuel supply and readily dissolved therein, and (b) promote an ignition temperature of carbon in the range of as low as 450° F. and up to below 675° F., the agent must be comprised of a very narrow selection of organometallic salts combined with a very narrow selection of aerosol-forming ingredient to form a very finely distributed codeposit of carbon and select metal oxides. The effective carbon ignition temperature will depend on (a) the species of organometallic salt selected, and (b) the deposited concentration of the oxide derived from the organometallic salt, which depends in part on the close packing or density of the codeposited soot particles.

The organometallic salt of use herein is first a metal octoate or octoate complex which upon heating forms a readily reducible oxide that combines, reduces or catalyzes the oxidation of carbon in the desired temperature range. An octoate is technically defined as a salt or ester of octoic acid, such as acaprylate or ethylhexoate. Octoic acid is defined as any of the monocarboxylic acids such as $C_7H_{15}COOH$ derived from the octanes: as caprylic acid or ethylhexoic acid. Secondly, the octoate or octoate complex has the formula $[C_xO_yH_z]_nM$, where M is a metal selected from the group consisting of copper, nickel and cerium, and x is 8, y is 2-4, z is 12-18 (preferably 17), and n is 1-4.

The oxide must be deposited along with the carbon deposit in such a finely divided state that the presence of the oxide is not recognizable under the microscope; the particle size of such deposited oxide is preferably less than 500 angstroms. The soot itself, which is codeposited therewith, is usually deposited as a cluster with the particles within the cluster being of the size of 50-60 angstroms and each cluster being 100-1500 angstroms in size. To obtain such extremely fine size deposition of oxide alongside the carbon, the physics of fuel evaporation and combustion must be taken into consideration in selecting the fuel additive. The additive must be more volatile than diesel fuel, for example, pentane or neptane, which evaporate at about 170°-200° F., whereas diesel fuel evaporates at about 300°-800° F. A droplet of fuel tends to have the surface thereof evaporate in layers, much as the peeling of an onion skin. When the first layer of the droplet evaporates and reacts with oxygen, the oxygen immediately surrounding the fuel droplet is depleted. In order for the next succeeding peeling layer of fuel to combine with oxygen, it must somehow overcome this intermediate region of oxygen depletion. When the oxygen cannot meet with the new peeling layer of fuel, the fuel tends to break down, forming hydrocarbons and carbon in a process analogous to cracking of petroleum, thus leaving a residue of carbon. By use of the fuel additive described herein, the metal octoate or octoate complex, along with the highly volatile aerosol-promoting carrier, tends to evaporate first, ahead of each succeeding layer of fuel, thereby intimately available to coalesce with the carbon particle formation. When passing through the combustion process, the evaporated octoate or octoate complex will form a first oxide that codeposits with the immediate formation of carbon due to such oxygen depletion. The extremely fine mist formed of the fuel and additive chemicals promote a very fine, intimate codeposition of carbon and the resulting first metal oxide.

The aerosol-forming ingredient is selected from the group consisting of hexane, pentane and toluene, has a boiling point in the range of 80°-150° C., and is readily soluble in the diesel fuel supply. The octoate or octoate complex is copper octoate or complex, or copper octoate and nickel octoate or cerium octoate.

For purposes of the preferred mode, the metal octoate or complex is formulated in a mixture with the aerosol-promoting liquid carrier in a ratio, by weight, of 1-2 to 1-10 and optimally about 1-4. Such agent of octoate salt and carrier is added to the fuel supply in an amount of 3-50 milliliters per gallon of diesel fuel. A metal octoate complex, useful for purposes of this invention, is $(C_8O_2H_{17})Cu$, a synthesized compound which is frequently referred to an an alkanoate, that is, it has two octoate radicals within the complex. Such alkanoate complex can be purchased from Shepard Chemical or Tenneco, and is readily known to have utility as a catalyst to dry paints on fabrics. This particular agent breaks down at lower temperatures in a very fine aerosol form. Prior art fuel additives tend to break down only at high exhaust gas temperatures and are waxy at lower exhaust gas temperatures, inhibiting the ability to form a finely divided oxide for codeposition with the carbon.

Increased ignition temperature depression can be achieved when copper octoate is combined with cerium octoate or nickel octoate, with the total combined additive octoates being in the range of 0.3-0.7 gm/gal of diesel fuel.

Although the reason for this is not fully understood, it is believed the following chemical/physical activities take place which account for this. The heat of combustion causes the octoate or octoate complex to reduce to a first copper oxide and hydrocarbons. This may be generally represented by the reaction:

$$[C_7H_{15}COOH]Cu + Q + O_2 \rightarrow CuO_x + H_nC_m$$

The first metal oxide has a multiple oxygen level for each associated metal atom, x being 0.5-3.0. For copper, x is 0.5-1.5, for cerium it is 0.7-2.25, and for nickel it is 0.5-2. This multiple oxygen level capability is important to achieving a lower carbon ignition temperature because it permits a reduction of the first metal oxide to a second metal oxide upon being reheated by exhaust gases in the codeposited state in the trap. For example, with copper as the metal, the first oxide (cupric oxide, CuO) will form a second oxide (cuprous oxide, $Cu_2O$) in the temperature range of 400°-500° F. (trap wall temperature); in addition, the deposited hydrocarbons will volatilize in this temperature range. Both reactions release heat, allowing the trap wall temperature to increase to higher levels; the oxide reaction releases oxygen in the form of $CO_2$ which can be used to oxidize carbon:

$$Q \text{ (from heat exhaust)} + 2CuO + CO \rightarrow Cu_2O + CO_2 + Q$$

$$CuO + C \rightarrow Cu + CO$$

Secondary reactions, which accomplish the ignition of carbon, will take place at a trap wall temperature in the range of at least as low as 450° F. and up to as low as 675° F., depending on the metal of the oxide and the deposited concentration of the oxide and carbon particles. For example, with copper oxide, the secondary reactions would be:

$CuO+C \rightarrow Co+Cu$
$2Cu+O_2 \rightarrow 2CuO$
$Cu_2O+CO \rightarrow 2Cu+CO_2$
$CO_2+C \rightarrow 2CO+Q$
$2C+O_2 \rightarrow 2CO+Q$ Unless the soot or carbon particles are densely packed (as exhibited by a soot density in the range of 350–450 mg/in$^3$ and there is an extraordinary number of reaction zones (a high concentration of metal oxide particles such as resulting from adding 0.5 gm/gal of fuel or greater), carbon ignition will not generally occur below 590° F. when using copper octoate or complex by itself. Thus, at copper oxide concentrations below 0.5 gm/gal of fuel, or trap back-pressures less than 250 mg/in$^3$, trap regeneration will not occur until the driving cycle of the vehicle heats the exhaust gas to trap wall temperature of at least 590° F. If the copper oxide concentration is the result of adding as little as 0.15 gm/gal of fuel of copper octoate or complex and the soot packing density is below 250 mg/in$^3$, the trap wall temperature must be at least 640° F. to achieve light-off.

When the density of the reaction zones is sufficiently high (350–450 mg/in$^3$ and copper octoate or complex added at 0.5 gm/gal of fuel or greater) heat from the initial oxide reduction and HC volatilization builds up, permitting the secondary reactions to occur at as low as 450°–475° F.; this is a direct result of retaining heat from the lower temperature reactions and not allowing such heat to run off with the exhaust gas flow through the trap. To sustain ignition and permit the carbon oxidation to proceed massively to complete regeneration of the trap, there must be an adequate supply of oxygen and heat for the carbon particles.

By the combination of nickel octoate or cerium octoate with copper octoate, the following secondary reactions take place in the 540°–700° F. temperature range:

$CuO+C \rightarrow CO$
$2NiO+C \rightarrow 2Ni+CO_2$
$2NiO+CO \rightarrow Ni_2O+CO_2$
or $NiO+CO \rightarrow 2Ni+CO_2$
or $CeO_2+2CO \rightarrow 2CeO+Ce$
or $CeO_2+CO \rightarrow CeO+CO$
or $CO_2+C \rightarrow 2CO+O$
$2C+O_2 \rightarrow 2CO+Q$ But, what is interesting, is that the product of the secondary reactions combine to produce more compounds available for secondary reactions which produce more concentrated heat:

$2Ni_2O+O_2 \rightarrow NiO$
$2Ni+O_2 \rightarrow 2NiO$
or $Ce+O_2 \rightarrow CeO_2$
$2CeO+O_2 \rightarrow 2CeO_2$ Thus, with the reactions from oxides of nickel or cerium present to supplement the reactions of oxides of copper, greater heat retention can be attained in the 500°–650° F. temperature range, allowing the ignition temperature to occur at as low as 540° F. with soot loadings of 250 mg/in$^3$ or less. With higher oxide concentrations, greater soot loadings (350–450 mg/in$^3$), the ignition temperature can be as low as 450° F.

Ni and Ce also seem to promote the oxidation of occuluded hydrocarbons in a manner analogous to the catalytic converter in gasoline engines by their unique characteristic of oxygen storage, that is, the reversible reactions previously explained. The added heat liberation makes the hydrocarbon reaction occur even more rapidly; Ce is apparently much more effective in this regard.

Method

A particulate trap containing carbonaceous particles extracted from the exhaust gas of an internal combustion engine having a fossil fuel supply can be regenerated by: (a) uniformly codepositing carbon particles and selected first metal oxides within the trap, the carbon particles being deposited in a size range of 50–60 angstroms and the selected metal oxides being deposited in a particle size on average of less than 500 angstroms and in a sufficient intimate concentration with the deposited carbon particles to promote, upon reheating by the exhaust gases, continued reduction of the oxides to a lower level of oxygen for the metal atom of the oxide [the oxides have multiple oxygen levels in the range of 0.5–3.0, are reactive in the temperature range of as low as 450° F. and up to as low as 675° F. to promote ignition of the carbon particles and may act as oxygen storing devices]; and (b) when the deposited density of the carbon particles and first metal oxides have reached a predetermined density, operating the engine at a speed, load and acceleration condition to increase the exhaust gas temperature and thereby the trap temperature to at least as low as 450° F. and up to below 675° F. and sustaining said temperature over a period of at least 8 seconds to reheat the first metal oxides, the metal oxides functioning under such trap temperature and exhaust gas flow [of at least 90 cfm] through said trap to reduce said metal oxides supplying oxygen for the chemical oxidation of the carbonaceous particles. Soot deposits at high densities, which restricts the exhaust gas flow and raises the trap back-pressure and ambient trap temperature, can influence regeneration to begin at trap wall temperatures as low as 450° F. This condition unfortunately results in heavy fuel economy losses with the trap back-pressure raised above 140 inches of $H_2O$ (gauge).

Preferably, the codeposition is carried out by introducing a flow of exhaust gases from the engine carrying the carbon particles and metal oxide particles in a finely distributed condition to the trap. The exhaust flow is preferably at least 0.5–2 atmospheres, thereby facilitating an oxygen concentration in the trap. The exhaust gases containing the metal oxides and carbon particles are the result of combustion of a finely divided aerosol mist of air, diesel fuel, and an additive effective to promote the formation of an oxide effective to depress the ignition temperature of the carbon particles when the metal oxides are codeposited therewith. The additive to carry out said metal, of course, is of the type that comprises an organometallic compound which forms a readily reducible metal oxide upon experiencing the combustion process of the engine, the metal oxide being of the type that promotes a carbonaceous ignition temperature in the range of as low as 450° F. and up to as low as 675° F. The additive also contains an aerosol-promoting liquid carrier effective to form a fine mist with the organometallic compound when sprayed for combustion, the carrier having a boiling point in the range of 80°–150° C. and is readily soluble in diesel fuel, the additive being dissolved in an amount of 0.1–0.6 gm/gal of fuel. An expanded process for carrying out such method can comprise the steps of dissolving the additive in the fuel supply, spraying the fuel supply and additive, heating the sprayed materials by combustion to form exhaust gases, and conducting the exhaust gases through the particulate trap to complete the codeposition step.

Test Samples

Laborabory and vehicle tests were carried out to demonstrate the benefits of this invention. In the laboratory a fuel additive stability test was undertaken which established the useful candidates for on-vehicle trap regeneration studies.

The fuel stability test comprised preparing a 1% (by volume) solution of each candidate fuel additive (which was approximately 0.06–15% metal additive by weight) in diesel fuel contained in a laboratory jar. The solvent for each additive was the fuel. Some sample additive solutions contained 1% water and others did not The list of candidate additives included acetyl acitanates, napthanates, octoate complexes, hexa carboxyls, acetates, oleates, stearates of Ni, Cu, Mo, Mn, V, Ce, W, Ba and Ca. Thorough shaking of each test solution was carried out every day. The solutions were inspected for any precipitate or turbidity after every 24–72 hours; the inspections were carried out for a period of three months. Those candidates which showed no visible color change or precipitation after three months included only the organometallic salts of acetyl acetanates, oleates, octoates or octoate complexes of Ni, Cu, Ce, V, Mn and Mo.

Regeneration vehicle tests comprised (a) indoor dynamometer steady-state vehicle operation, (b) outdoor test track acceleration vehicle operation, and (c) a 100 mile road durability test. For all of these tests, including the indoor dynamometer tests and the outdoor test track tests, a 2.3 liter Opel diesel test vehicle was used; the vehicle was fitted with a close coupled particulate trap mounted at the exhaust manifold and equipped with fast response thermocouples (0.05 second response) to monitor the gas temperatures at the trap inlet and outlet and to monitor the trap wall temperature at a mid-bed location. The temperatures were recorded continuously during the tests; nearly identical vehicle road load and trap temperatures were maintained at the start of all tests to insure uniformity of test conditions for all additive formulations. A new trap filter was used for each additive formulation (the trap filter was a ceramic by Corning EX-47, 100 cpi, 17 mil wall, 4.66 inch diameter and 5.0 inch length, porosity of about 45–50%, and a pore size of 0.5–10 microns). The diesel fuel used was Phillips D-2 control fuel (an industry standard). The organometallic salt additives for the vehicle tests were:

| Sample | Organometallic Salt |
|---|---|
| 1 | .25 gm of copper/gal of fuel, as copper napthanate, + .5 gm lead/gal of fuel as tetraethyl lead. |
| 2 | .3 gm copper/gal of fuel as copper octoate (5.25 cc's of copper octoate complex). |
| 3 | .25 gm copper/gal of fuel as copper octoate (4.5 cc's of copper octoate complex. |
| 4 | .25 gm copper octoate/gal of fuel + .25 gm nickel octoate/gal of fuel (4.5 cc's of copper octoate complex + 2.0 cc's of nickel octoate). |
| 5 | .25 gm/gal of fuel copper octoate + .20 gm cerium octoate/gal of fuel (4.5 cc's of copper octoate complex + 2.0 cc's cerium octoate). |

-continued

| Sample | Organometallic Salt |
|---|---|
| 6 | None. |

To samples 2–6, 20 cc's of heptane was added to constitute the additive agent. Useful formulations are listed in Table I.

Indoor Dynamometer Tests

The vehicle trap was loaded wiht soot by operating the engine at steady cruise of 40 mph, generating a trap wall temperature of about 400° F.±10° F., at a road load of 6.73 HP. The soot loading was carried out until a back pressure at the trap of 100 inches of $H_2O$ was achieved. After the trap was soot loaded to the degree as indicated by the selected back-pressure, the trap temperature was raised in 50° F. increments by increasing the road load and thereby the exhaust gas temperature. For accelerated tests, the same procedure was followed except that after the desired soot loading was achieved, the vehicle was brought to zero speed and then accelerated from zero to 40 kmh by using full throttle, or accelerated to other levels as the test required.

It is important to point out that the temperature to be depressed, by virtue of the use of the agent of this invention, is more closely related to the trap (wall) temperature and not that of exhaust gas temperature. As shown in FIG. 1, the exhaust gas temperature at the inlet to the trap (see plot A) will take a path substantially different than the mid-bed wall temperature of the trap (see plot B). The plot A comprises soot loading and acceleration from 0–40 kmh. Note the highest attained temperature of B is about 340° F. In the 0–50 kmh, the trap wall temperature O barely reaches 700° F., and in the 0–60 kmh, the trap wall temperature F reached about 750° F. FIG. 1 is for temperatures observed in the absence of regeneration in the trap.

Figure 2:
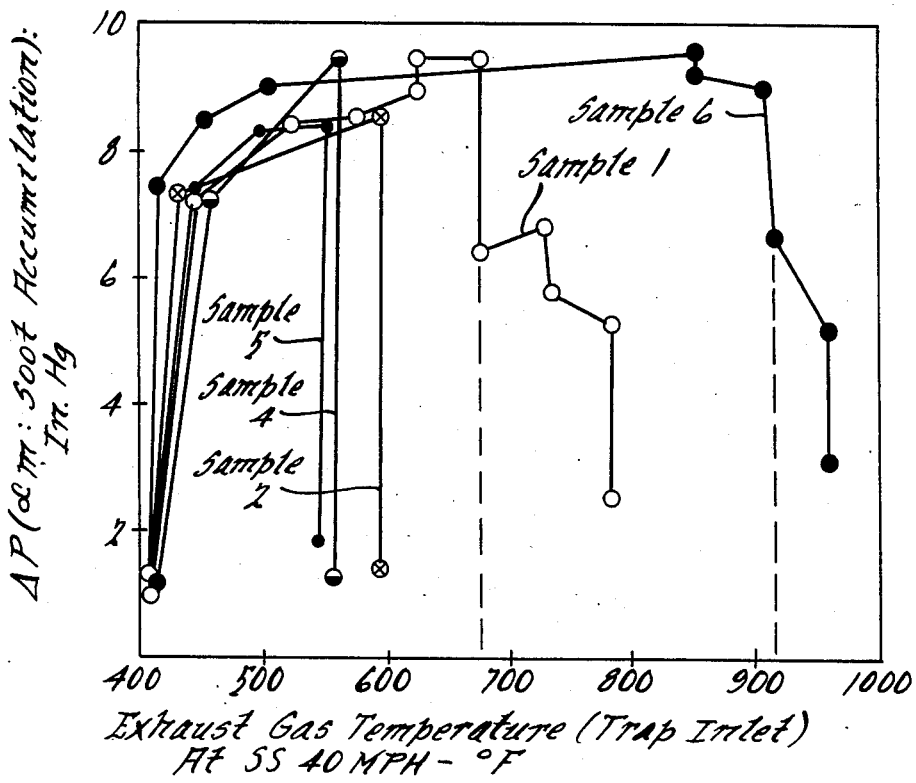

The results as to regeneration of the trap at steady-state speed conditions are shown in FIG. 2. Sample 6 (without any additive) regenerated at 925° F. and Sample 1 regenerated at 680° F. and was only 40% regenerated. Sample 2 had to have the trap temperature raised to 790° F. to achieve nearly complete regeneration. Samples 2–5 showed a remarkable reduction in soot ignition temperature. Sample 2 reduced to 590° F., Sample 3 to 625° F., and Samples 4 and 5 to 540° F.

As shown in FIG. 3, Samples 1–5 showed the characteristic sharp rise in temperature due to rapid combustion of soot following light-off, with peak temperatures rising above 900° C. These peak temperatures are significantly lower than peak temperatures observed in auxiliary burner or heater regeneration characteristics of the prior art. More importantly, in the case of the use of the combination additive of 0.25 gm/gal of fuel of copper octoate and 0.2 gm/gal of cerium octoate (Sample 5), such formulation allows the regeneration to be spread out over a few additional seconds generating no sharp peak temperature at all, and the temperature of ignition at 400°–500° F. changes during regeneration only to as high as 600° F. The trap back-pressure, after regeneration, dropped nearly to the clean trap back-pressure in all cases, except the copper and lead reference formulation where after regeneration the trap back-pressure was 40 inches of $H_2O$ (see FIG. 3). With the copper plus lead reference formulation (Sample 1), partial regeneration only took place to the extent of about 40% at light-off of 680° F. and required greater than 750° F. for complete regeneration.

Figure 4:
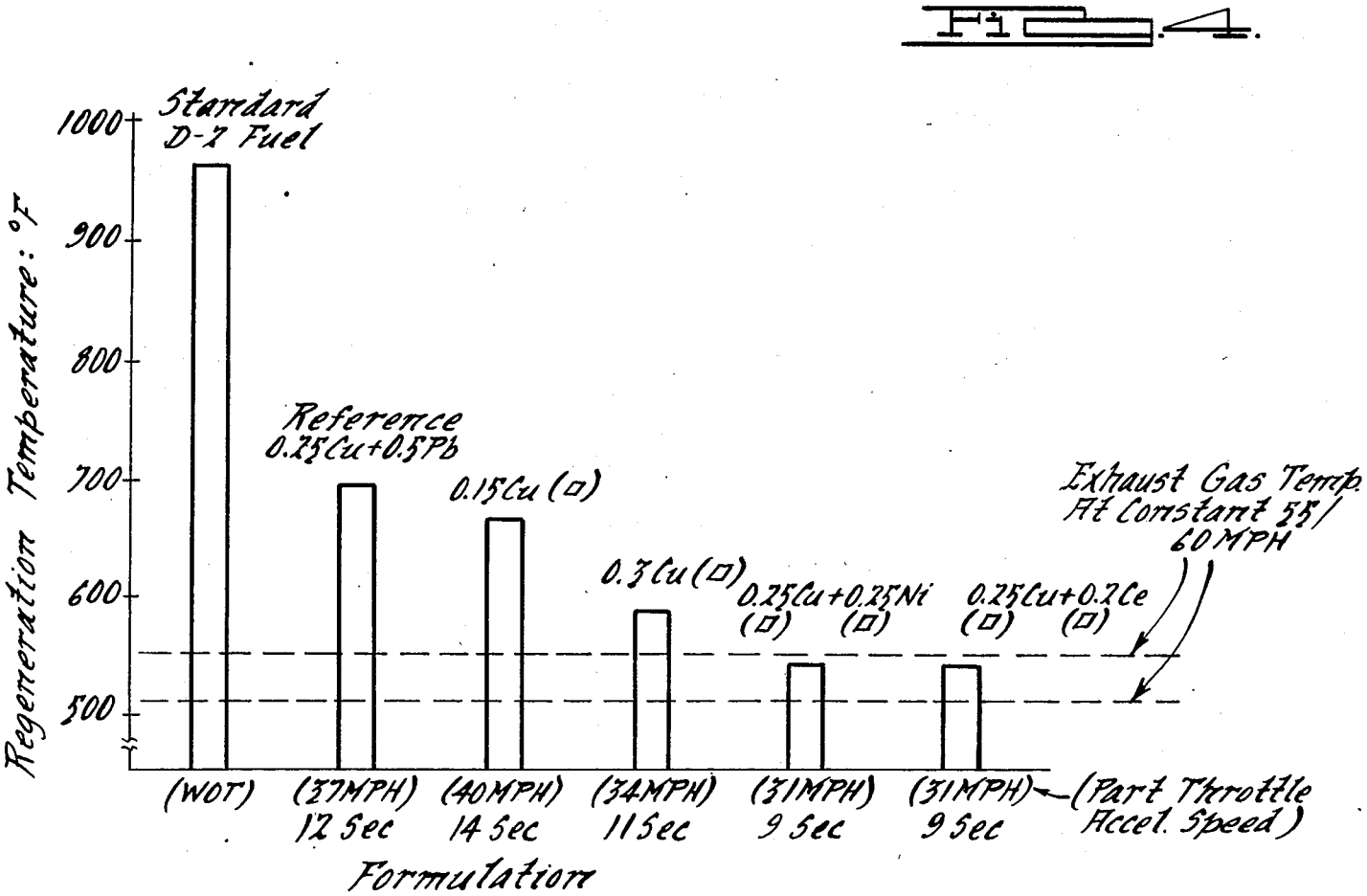
Figure 5:
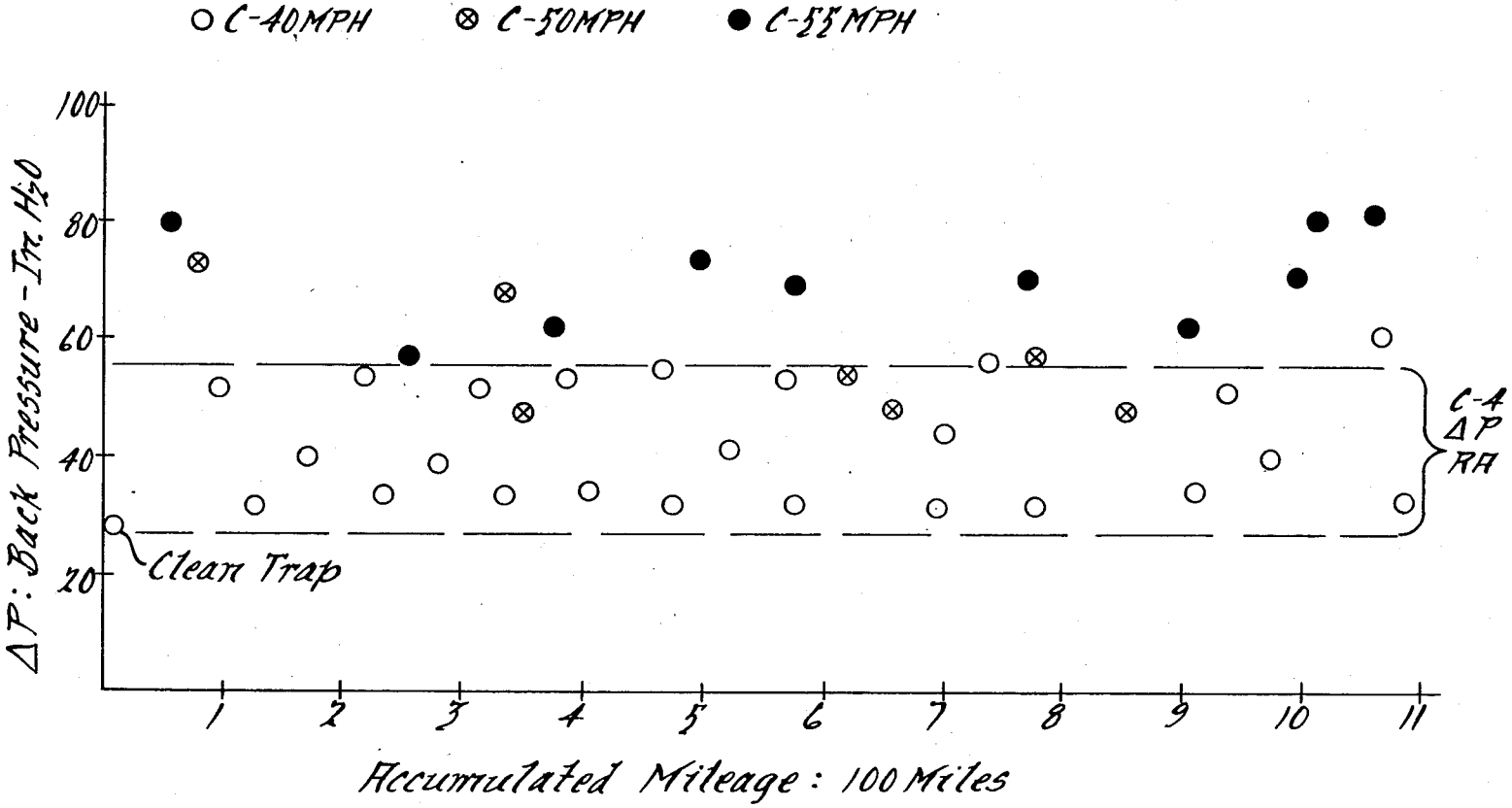

FIG. 4 shows a more direct evaluation of ignition temperatures by bar graphs. The graphs are arranged to illustrate light-off or ignition (measured at the trap wall) temperature that is necessary to initiate regeneration. The trap was loaded with soot, as indicated earlier, at steady-state cruising speeds of 40 mph and then subjected to an accelerated speed from zero to the indicated speed shown at the bottom of each bar graph. It is interesting to note the amount of time that it took for light-off to take place during such acceleration. The octoates, and particularly the combination of octoates, produced the lowest ignition light-off temperatures at the lowest acceleration speeds.

Acceleration Tests

With the use of a small amount of copper octoate in the amount of 0.1 gm/gal diesel fuel, zero to 70 kmh acceleration was necessary to obtain sufficient temperature to ignite the carbonaceous particles with such small amount of additive. However, with 0.15 gm/gal of diesel fuel of the copper octoate, the zero to 60 kmh acceleration test was sufficient to produce complete regeneration. The formulations of 0.375 gm/gal of copper octoate or 0.25 gm/gal of fuel of copper octoate plus 0.25 gm/gal of fuel of nickel octoate provided complete regeneration with the acceleration test of zero to 50 kmh. It is thus evident that the combinations of copper octoate and nickel octoate or cerium octoate provide the lowest regeneration temperatures and assume a synergistic effect by such use.

During these steady state and in the acceleration tests, it was found that the only way to obtain trap regeneration with the diesel fuel having no additives (sample 6) or having the copper plus lead reference formulation additive (sample 1), was to utilize the wide-open throttle or full power condition or a 0–70 mph acceleration cycle. Either of these driving conditions generated an exhaust gas temperature in excess of 700° F. But even with wide-open throttle for the basic unadulterated diesel fuel, the regeneration did not proceed to completion but only to about 80%, except at sustained operation above 75–80 mph in an acceleration mode for at least 20 seconds.

Durability Test

As a part of the evaluation of the tests, the distribution of the metallic elements of the fuel additives in the emissions during steady-state and acceleration tests was determined by means of X-ray fluoresence and plasma emission spectrometry. These results show that even in the case of an acceleration test, the copper and nickel in the tailpipe emissions are less than 5% of those in the feed gas emissions. This represents a maximum of 0.001 grams of nickel and/or copper per mile in tailpipe emissions. During normal driving, where there is no regeneration, there is no metallic elements detected in the exhaust gas. It is most significant to point out that the deposits of metallic elements after the regeneration has taken place within the trap itself tend to enhance the trapping capability of the trap; that is, the metallic elements condense at the trap surface in the form of sponge and function as a porous matrix. Thus, the condensation of the metallic elements facilitate and continue the trapping capability of the filter trap. Metallographic examination of the filter traps after a 1600 mile on-road service test with the use of an additive comprised of 0.25 gm/gal of fuel of copper octoate and 0.25 gm/gal of fuel of nickel octoate following a regeneration showed the copper and nickel elements in the form of a discontinuous layer or dense, porous granules less than 0.0005 inches thick. Assuming that the useful service life of the trap is limited to the filling up of only half of the filter inlet channel volume, then a filter volume of twice the engine displacement will provide at least 50,000 miles durability or life for a filter using such additive formulation.

A long distance road trip test was carried out to test the durability and functionality of a chemical additive formulation using 0.25 gm/gal of fuel of copper octoate and 0.25 gm/gal of fuel of nickel octoate. The driving cycle consisted of approximately 8% highway driving at 45–55 mph and 20% city driving. The trap back-pressure seldom exceeded twice the clean trap back-pressure during the entire test and the trap regenerated frequently using normal driving (see FIG. 6). The average back pressure at cruising speeds of 40 mph for the entire test was approximately 50 inches of water, which represents 3.5% fuel economy penalty. Fuel economy penalty can be reduced significantly by increasing the filter volume and modifying the filter pore configuration.

Back Pressure

The trap loading, that is, the back pressure created in the trap, produces a variable effect upon the required ignition temperature for establishing light-off of the carbonaceous particles. For example, the filter size employed with the tests herein at the steady-state cruise conditions makes a difference. For example, the smaller filter size employed with the steady-state conditions and acceleration tests herein had a volume size of about 65 cubic inches, whereas with the larger size filter (volume size of about 119 cubic inches) greater soot loading is required to achieve equivalent back-pressures in the larger size. Thus, if the back-pressure were the only criteria, the exhaust flows through the filters at such equivalent back-pressures would be different; that is, more oxygen is permitted to migrate through the trap within the larger size filter than the smaller size filter.

Figure 5:
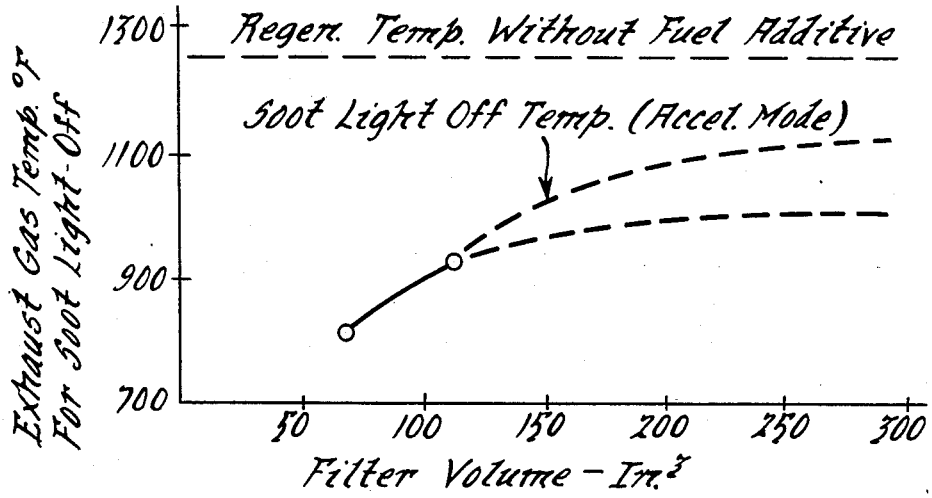
Figure 2:
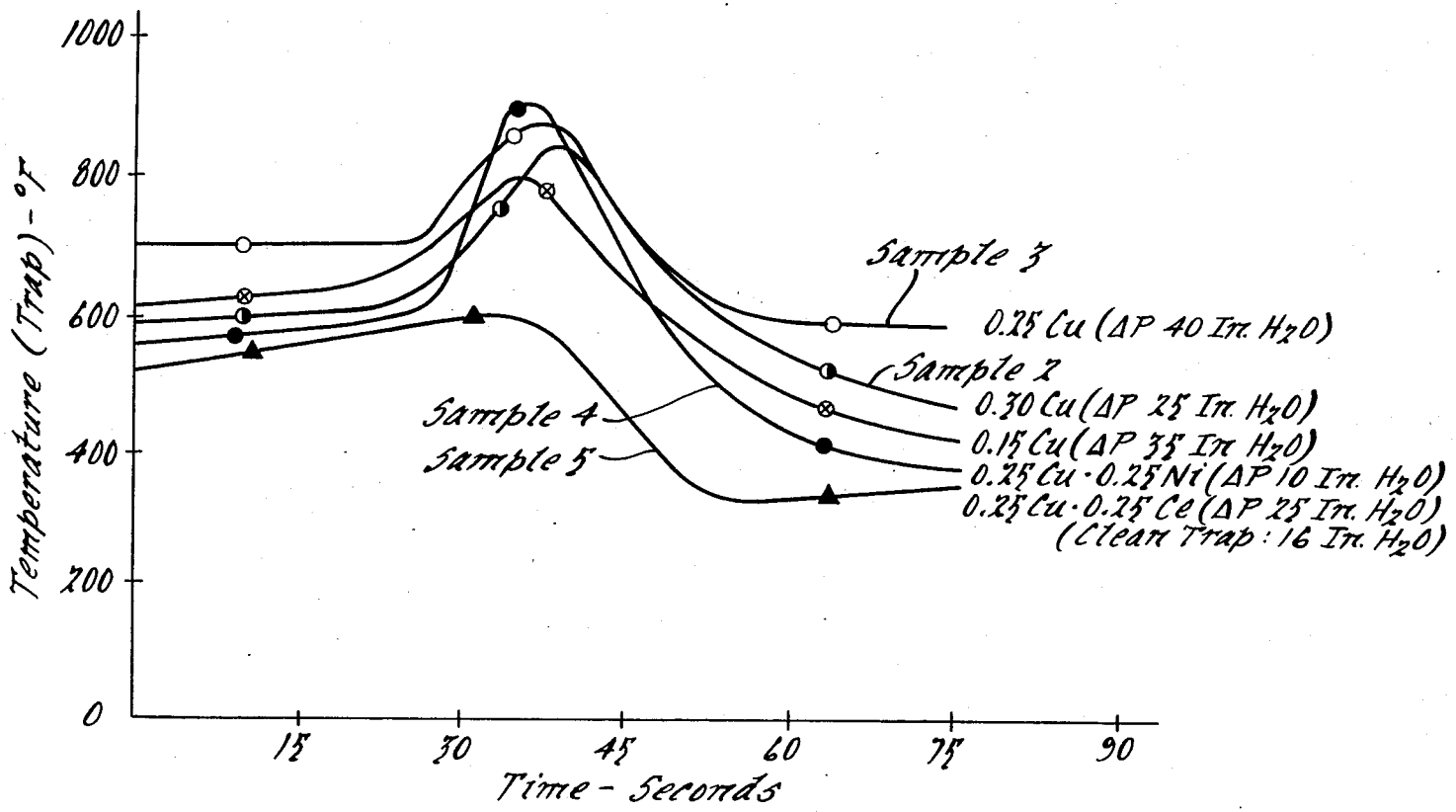

It has been determined as a result of the investigation work with this invention that with copper octoates or a combination of copper octoates and cerium or nickel octoates, the ignition temperature of about 540°–590° F. will hold true only if the ratio M (pressure of loaded trap to pressure of clean trap) is about 3. For every 0.5 decrease in the M ratio, the trap ignition temperature has to be increased by about 35° F. Thus, for a filter size which is twice that employed in the test, the ignition temperature required would have to be about 40°–50° F. higher. The larger size trap allows the back-pressure or atmospheric of the gas flow to be somewhat lower. For example, through the smaller size trap at 100 inches of water back-pressure, the atmospheric pressure of the gas flow will be about 1.25 gauge. However, with a filter size twice that utilized in the test, the same equivalent back-pressure will be achieved at 50 inches of water, which is equivalent to an atmosphere pressure of about 1.1. With the lower atmospheric pressure, less oxygen is migrating through the trap during the regeneration. Therefore, a higher temperature is required to ignite under the slightly restricted oxygen flow conditions (see FIG. 5).

TABLE I

| Metallic Element in the Compound | Concentration gm/gal | Fuel Additives Form | Carrier |
|---|---|---|---|
| Lead | 0.5 | Tetraethyl Lead | Motor Mix |
| Copper | 0.25 | Napthenate | |
| Copper | 0.15–0.5 | Octoate Complex (45 wt % Metal) | Heptane* 5–15 cc/gm of Cu |
| Copper | 0.25 | Octoate Complex (45 wt % Metal) | 5–15 cc/gm of Cu |
| Nickel | 0.25 | Octoate Complex (22.5 wt % Metal) | 5–15 cc/gm of Ni |
| Copper | 0.25 | Octoate Complex (45 wt % Metal) | 5–15 cc/gm of Cu |
| Cerium | 0.20 | Octoate Complex (45 wt % Metal) | 5–15 cc/gm of Ce |

*Part of the heptane can be substituted with mineral spirits of less than 105° C. boiling point - primarily paraffinic.

We claim:

1. A carbon ignition, temperature-depressing agent for addition to the fossil fuel supply of an internal combustion engine and effective to promote oxidation of collected carbonaceous particles extracted from the exhaust gas of the engine, the agent consisting of:

(a) a metal octoate organometallic compound that upon experiencing the combustion process of the internal combustion engine forms a first metal oxide readily reducible upon reheating by said exhaust gas to a second metal oxide of lower oxygen level, which second metal oxide promotes oxygen transfer and thereby a carbonaceous ignition temperature in the range of 450°–675° F. (250°–307° C.); and (b) an aerosol-promoting liquid carrier effective to form a fine mist with the organometallic compound and fuel supply when sprayed for initiating said internal combustion, said carrier having a boiling point in the range of 176°–302° F. (80°–150° C.).

2. The agent as in claim 1, in which said carrier is selected from the group consisting of hexane, pentane and toluene.

3. The agent as in claim 1, in which said metal octoate employs a metal selected from the group consisting of copper, nickel and cerium.

4. The agent as in claim 3, in which said organometallic compound is selected to form said second metal oxide which promotes said ignition without reversible oxygen transfer between said first and said second metal oxides.

5. The agent as in claim 1, in which the organometallic compound is copper octoate or copper octoate complex.

6. The agent as in claim 5, in which first metal oxide is cupric oxide and said second metal oxide is cuprous oxide or any copper oxide having an oxygen level between said cupric and cuprous oxides.

7. The agent as in claim 5, in which said copper octoate has the formula $[C_xO_yH_z]_nM$, where M is the metal and x is in the range of 8–16, y is in the range of 2–4, z is in the range of 12–18, and n is 1–4.

8. The agent as in claim 1, in which said organometallic compound is selected to form said second metal oxide, which promotes said ignition, with reversible, continuous exchange of oxygen transfer between said first and said second metal oxides.

9. The agent as in claim 8, in which said organometallic compound is comprised of two or more metal octoates.

10. The agent as in claim 9, in which said selected metal octoates are present in generally equal proportions.

11. The agent as in claim 9, in which said compound is comprised of copper octoate and nickel octoate.

12. The agent as in claim 9, in which said compound is comprised of copper octoate and cerium octoate.

13. The agent as in claim 1, in which said organometallic compound is proportioned to said carrier within said agent in a volumetric ratio of 1:2 to 1:10.

14. The agent as in claim 1, in which the first and second metal oxides have the molecular formula of $M_xO$, where M is the metal and x is 0.5–3.0 when copper is selected, 0.7–3.0 when cerium is selected, and 0.5–2 when nickel is selected.

15. A carbon ignition depressing agent for addition to an automotive fuel supply and effective to promote oxidation of on-board collected carbonaceous particles extracted from the exhaust gas of an automobile engine, the engine comprising:

(a) a combination of at least two metal octoates, with the metal differing between said at least two octoates, said metal for said octoates being selected from the group consisting of copper, nickel and cerium; and (b) an aerosol-promoting liquid carrier effective to form a fine mist with said octoates and fuel supply when sprayed to initiate combustion, the carrier having a boiling point in the range of 176°–302° F. (80°–150° C.), said combination of octoates being present in said agent in a ratio with respect to the aerosol-promoting liquid carrier of 1:2 to 1:10.

* * * * *